United States Patent [19]

Guggemos

[11] Patent Number: 4,794,502

[45] Date of Patent: Dec. 27, 1988

[54] STACKING LOUVER FOR LIGHT FIXTURE

[75] Inventor: Arthur R. Guggemos, Winsted, Minn.

[73] Assignee: Sterner Lighting Systems Incorporated, Winsted, Minn.

[21] Appl. No.: 96,924

[22] Filed: Sep. 14, 1987

[51] Int. Cl.[4] ..... F21V 5/00

[52] U.S. Cl. ..... 362/331; 362/224; 362/268; 362/332; 362/363

[58] Field of Search ..... 362/224, 225, 268, 331, 362/332, 363, 367

[56] References Cited

U.S. PATENT DOCUMENTS

| | | | |
|---|---|---|---|
| 2,617,918 | 11/1952 | Foster | 362/224 |
| 3,593,014 | 7/1971 | Vesely | 362/263 X |
| 3,646,338 | 2/1972 | Goytisole | 362/294 |
| 4,175,661 | 11/1979 | Barnes | 206/519 |
| 4,438,484 | 3/1984 | Winden | 362/267 |
| 4,447,864 | 5/1984 | Smith et al. | 362/311 |

FOREIGN PATENT DOCUMENTS

| | | | |
|---|---|---|---|
| 213285 | 2/1961 | Austria | 362/225 |
| 1085411 | 7/1954 | France | 362/225 |
| 398419 | 9/1933 | United Kingdom | 362/331 |

*Primary Examiner*—Samuel Scott
*Assistant Examiner*—Allen J. Flanigan
*Attorney, Agent, or Firm*—Kinney & Lange

[57] ABSTRACT

A stackable louver assembly for light fixtures which can be made of a high strength polycarbonate light transmitting plastic material and which has a sleeve and louver flange molded in one piece so that the sleeve will not be lost or discarded at the job site. The louver assembly becomes self-enclosed. The louver assemblies are made so they can be stacked one on top of the other and fastened with tie rods at desired locations. The sleeve that supports the louver flange is made with a surface that is generally parallel to the longitudinal axis of the assembly, and can be provided with v-type grooves to provide refraction of the light emanating from an interior lamp. The grooves can be molded into the plastic with no increase in cost, and will reduce glare and improve overall performance of the fixture. Likewise, the louver flanges may have surfaces that are provided with refraction grooves, as well.

15 Claims, 3 Drawing Sheets

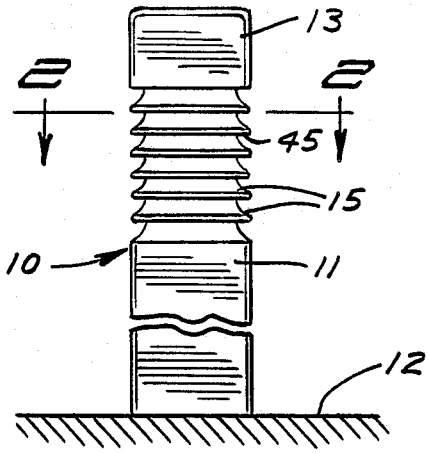
FIG. 1
FIG. 2
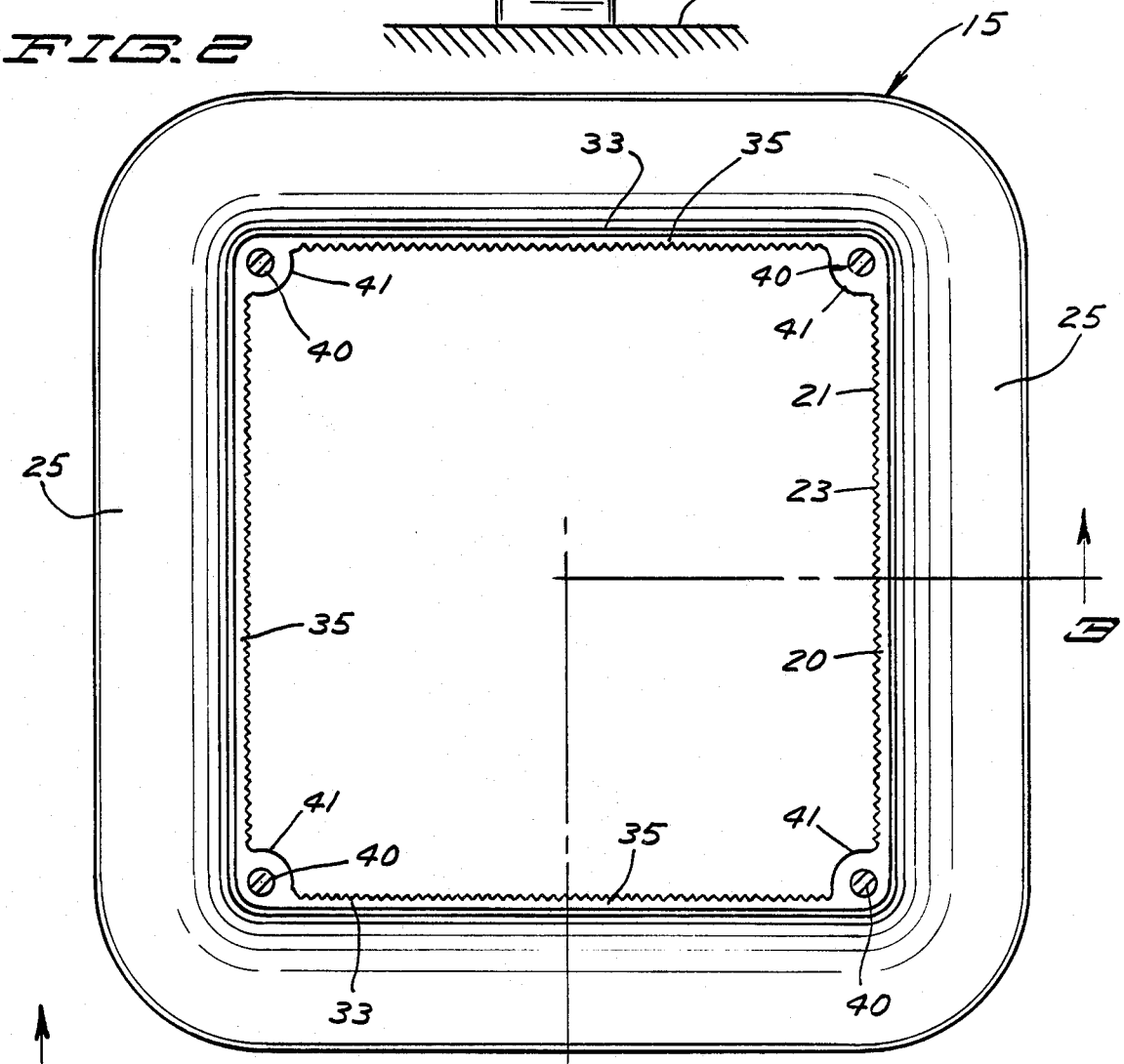
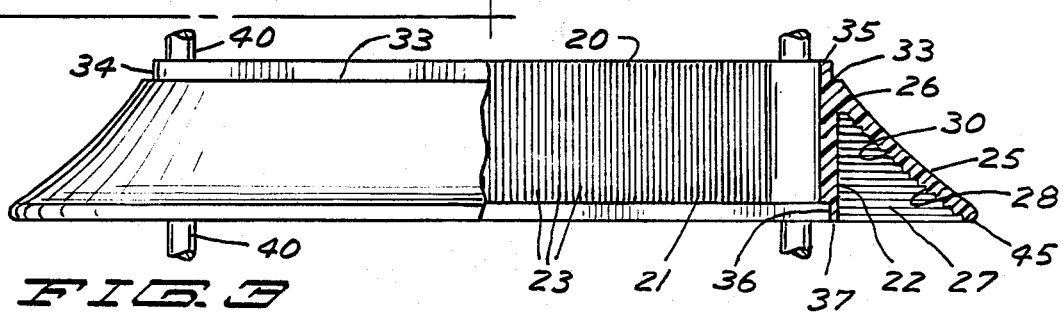
FIG. 3

STACKING LOUVER FOR LIGHT FIXTURE

BACKGROUND OF THE INVENTION

1. Field of the Invention

The present invention relates to lighting fixture louvers.

2. Description of the Prior Art

In the lighting industry, there have been numerous fixture types fitted with louvers. The louvers are used to shield a bare lamp from direct lines of sight to remove distracting glare, and also to direct the light from the lamp into a desired location. One of the currently most popular types is a Bollard light. This is a short post-like fixture used for accent and area lighting of outdoor areas. The louvers, usually seven or more in number, make it possible to shield the lamp and direct the light downwardly. Without the louvers, the light from such low level fixtures would be very objectionable to pedestrians and drivers alike.

The louvers that have been used in the past are merely annular rings or flanges that are spaced apart on supports and surround a central chamber in which the light is mounted. The open areas between the louvers permit fingers to be accessed into the lamp area, and allow weather and insects to enter the fixture. Sticks, rods and the like could be inserted upwardly through the louver openings and used to break the lamps.

In addition, an internal sleeve has been made of a tough plastic and then fixed to the inside opening of the louvers with mechanical parts. This sleeve is frequently discarded or lost, making the fixtures hazardous or inconvenient.

These problems are overcome with the present design.

SUMMARY OF THE INVENTION

A high strength louver assembly including a central sleeve, and an outer peripheral louver flange that provides for direction of light emanating from the center of the sleeve. The louver and self-enclosing sleeve can be stacked one on top of the other and fastened with tension tie rods at desired locations, for example, at their corners, if made into a rectangular or square configuration. The louvers are made so that they will stack and interfit at their edges, so that one louver has a neck that fits inside a recess in the next sleeve, effecting a weather-tight and insect-tight seal.

In a modified version, the louver is made in two pieces, with a center sleeve and a louver portion that fits over the sleeve in a two piece assembly. The sleeve also can be stacked one on top of the other without a louver between them for specific applications.

Vertical grooves or striations designed to refract the light emanating from a lamp on the interior of the sleeve can be formed on the inner or outer surface of the sleeve to diffuse the light, reduce glare and improve overall performance. Additionally, the undersurface of the louvers can be provided with refracting grooves for light diffusion and better direction and control of the light. The light actually can be directed around the bolts used to eliminate shadows normally caused by vertical tie bolts.

The louver parts can be made in a clear plastic, or tinted bronze or grey if desired. Plastic ties such as polycarbonate polarlate and/or polysulfone can be used. It must be a high temperature plastic that is optically clear. Ultraviolet inhibitors can be used to prevent discoloration and breakdowns. A frosted finish can be put on the plastic quite easily. The louvers themselves can be painted on their exposed surfaces, or can be vacuum metalized in bright specular aluminum, or any desirable color. The polycarbonate is easily finished in a variety of colors.

The louvers can be oriented so that they all extend in the same direction from the sleeve, or can be reversed so that they mate and form different configurations, as will be seen.

BRIEF DESCRIPTION OF THE DRAWINGS

FIG. 1 is a side elevational view of a typical Bollard light showing a louver made according to the present invention installed therein;

FIG. 2 is a sectional view as on line 2—2 in FIG. 1;

FIG. 3 is a sectional view taken as on line 3—3 in FIG. 2;

DETAILED DESCRIPTION OF THE PREFERRED EMBODIMENTS

Figure 4:
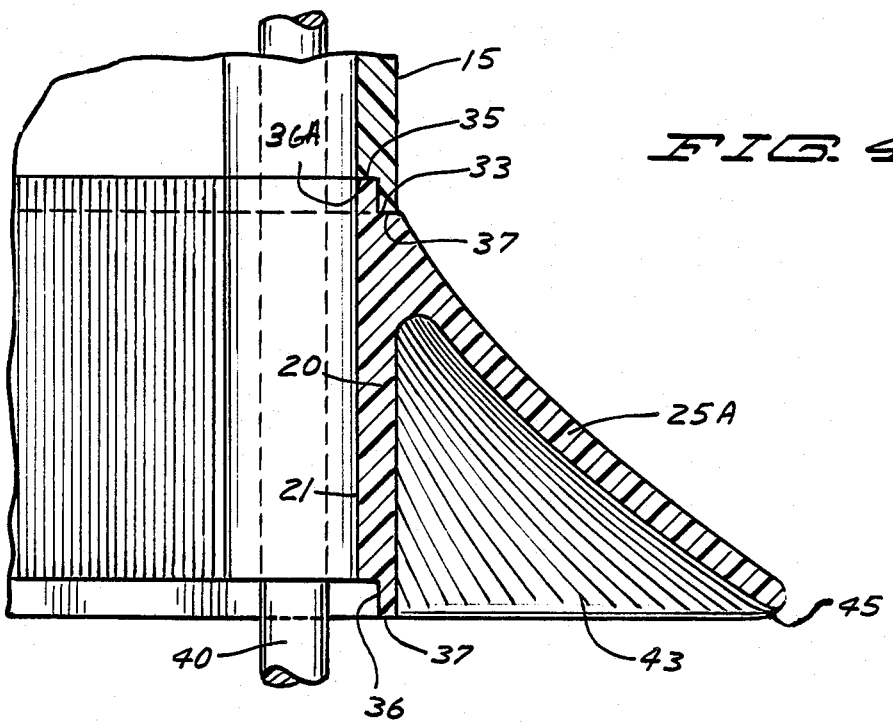
FIG. 4 is an enlarged sectional view of the louver of the present invention and showing details of the interfitting edges of adjacent sleeves.

Refering to FIG. 1, a Bollard post-type lamp indicated generally at 10 includes a support post 11 mounted on the ground 12, having a cap 13 thereon. A light socket is generally mounted on the interior. The fixture is shown having a plurality of stacked unitary louver and sleeve assemblies 15 made according to the present invention. Assemblies 15 are used for directing the light from an internal lamp (not shown) downwardly around the post, and to eliminate the direct glare of the lamp or luminaire positioned on the inside of the sleeve.

FIG. 2 shows the general configuration of a typical unitary sleeve and louver assembly 15, and FIG. 3 shows a sectional view of such assembly. The louver assembly 15 as shown has a central sleeve 20 that constitutes a peripheral wall having an inner surface 21, and an outer surface 22. Normally, a luminaire or lamp is positioned within the sleeves generally along the central axis, and light would shine out through the vertical wall of the sleeve 20. As shown, the inner surface 21 has a plurality of axially oriented grooves 23 formed in the surface that form prism-type refracting surfaces for diffusing the light that passes through the plastic sleeve wall 20. These grooves can be on the outer surface of the sleeve as well.

A louver flange indicated at 25 is integrally molded with the wall 20 adjacent an upper end as shown at 26. The louver comprises an outwardly, tapering peripheral flange wall that is continuous around the sleeve 20 and tapers outwardly from one end toward the other end so that there is a space indicated at 27 for light to be directed downwardly from the undersurface 28 of the louver. The louver undersurface 28 also, as shown, has v-grooves 30 that are generally horizontal, that is, generally perpendicular to the grooves 23 on the inner surface 21, to aid in diffusing light and directing light in the proper locations. These grooves 30 can be molded in at the time the entire louver assembly 15 is molded. The angle of inclination of the louver 25 can be the standard angles that are used with present louvers. The integral assembly provides assurance that the parts will not get lost, and will continue to form the necessary enclosure.

As can be seen in FIG. 3, the upper and lower edges of the sleeve 20 are provided with interfitting shoulder surfaces. An upwardly facing outer shoulder surface 33 is formed by having a peripheral recess 34 forming an internal collar 35 that fits within an internal recess 36 on the bottom of the next adjacent louver assembly. The internal recess 36 forms an outer flagne 37 that has a surface that fits against the shoulder 33 and outside of the wall section 35, to telescope or nest the louver sections together as shown in FIG. 4. In other words, they have interfitting, interlocking sections between the adjacent edges of the stacked louvers. There are at least two abutting surfaces that seal the interior of the sleeve.

Any number of louver assemblies 15 can be stacked on top of each other, and then they are held in place with suitable tie rods indicated generally at 40 which are positioned in openings extending through bosses 41 at the corners of the louver assembly shown in FIG. 2. The tie rods then are either threaded into appropriate receptacles in the post 10 or into nuts that are welded in place and nuts at the opposite ends of the tie rods that are tightened down for assembly.

In FIG. 4, a modified version of the louver flange 25 is shown at 25A, and includes v-shaped grooves 43 on the undersurface of the louver flange. These grooves 43 extend generally parallel to the central axis of the louver sleeve, or in other words at substantially right angles to the grooves 30 that are shown in FIG. 3, for variations in the type of light diffusion that can be made available.

The lower edges of the louver flanges which are indicated at 45 in both FIGS. 3 and 4 terminate along a plane that is substantially coincidental with the lower edge surface of the telescoping flange 37 of the sleeve, and this permits the louver assemblies to be positioned so that the edges 45 face each other. For example, in FIG. 5 a lighting fixture 50 is shown to have a short horizontally extending post 51 mounted on a vertical wall 52 such as a building wall, and a support housing 53 at the outer end that supports a light and also supports the tie rods 40 that are used. In this instance, the individual louver assemblies 15 are positioned so that the edges 45 are mating on two louver assemblies, and then the louver assemblies are stacked as shown in FIG. 4. The associated pairs of louver assemblies are mated with an adjacent pair to provide a different configuration for changing the external appearance of the light.

In other words, the louver assemblies are capable of being stacked end-to-end in orientations 180° from each other. When stacked with the edges 45 contiguous, the inner chamber of the sleeve 20 is still closed or sealed with two mating surfaces, namely, the surfaces at edges 45 of flanges 25 and the facing end edges of the telescoping flanges 37.

Figure 6:
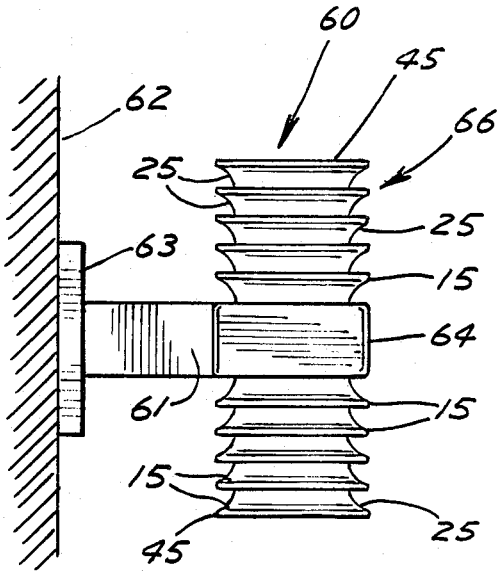
FIG. 6 is a further variation of a fixture having the louvers of the present invention mounted in a different manner.

In FIG. 6, a further modified light fixture indicated at 60 is provided, and in this instance a horizontal arm 61 is mounted onto a vertical wall 62 with a suitable bracket 63, and has a housing 64 that will support both up and downwardly extending light bulbs or luminaires. The louver assemblies 15 on the lower side of the housing or support 64 are oriented as shown in FIG. 1, with the flanges 25 extending downwardly, but on the upper side of housing 64 the louver assemblies 15 are inverted to form a fixture 66 that has the louvers 25 extending upwardly from their supporting sleeve.

Variations of the orientation of the louvers can be made as desired to achieve unique configurations.

Figure 7:
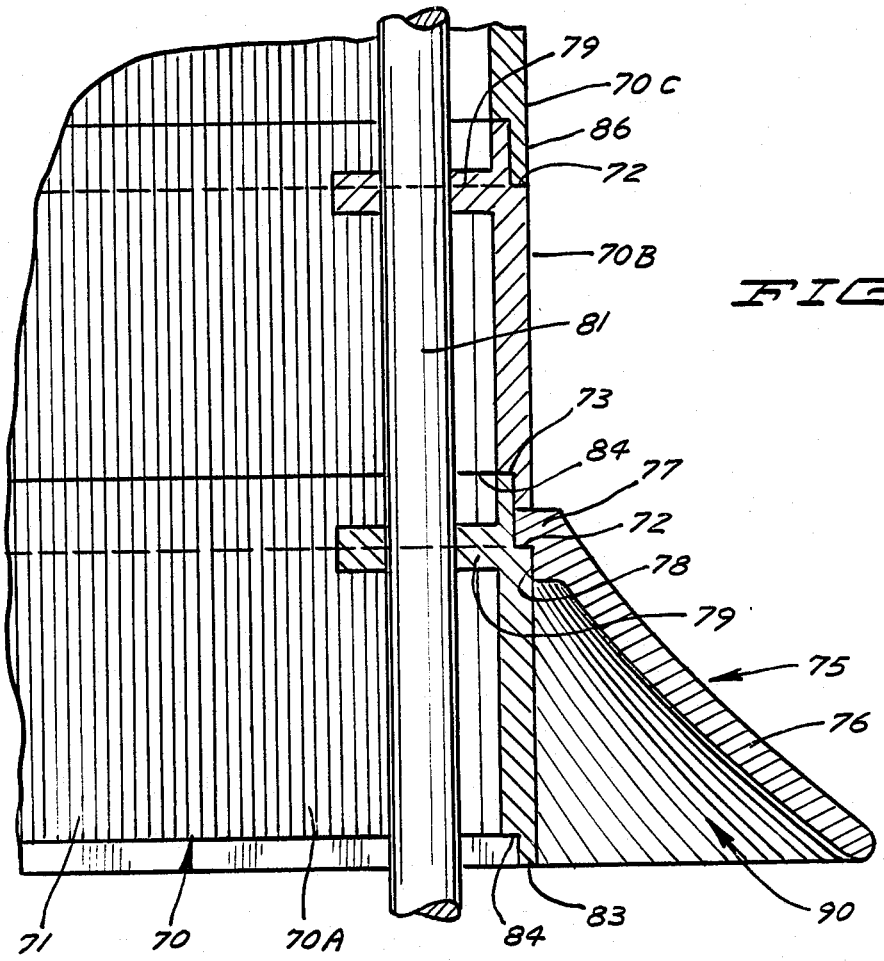
FIG. 7 is a vertical sectional view of a corner portion similar to that shown in FIG. 4 showing a modification of the louvers of the present invention.

In FIG. 7, a modified version of the louver assembly shown in FIGS. 2 and 3 is illustrated. The sleeves and louver or flange assembly can have the square configuration shown in FIG. 2, or they can be round if desired. The view of FIG. 7 corresponds to the view of FIG. 4 with the modified form shown. In this modified form, there are sleeve members shown generally at 70 including a first sleeve member 70A that is a molded peripheral sleeve having an internal serration shown at 71 on its inner surface corresponding to the serrations shown in FIG. 2. The sleeve corresponds in plan view to that figure. However, the sleeves 70 are made without an integral lower flange. The end edges of the sleeves have an upwardly facing outer shoulder surface indicated generally at 72 corresponding to the shoulder surface 33, which is formed by a peripheral external recess that forms a collar 73 corresponding to the collar 35.

In this form of the invention, however, it can be seen that a louver 75 is made separately from the sleeve 70A, and includes an outer peripheral downwardly and outwardly sloped flange 76, and an inner peripheral neck portion 77 that has an internal recess 78 forming a shoulder that mates with the shoulder 72 and rests thereon. This internal recess 78 is formed to be in the same configuration and as the sleeve, for example, if the sleeve has the rectangular configuration as FIG. 2, the louver 75 would be rectangular, and the flange 76 would extend out in the same manner as the louver 25. The central opening in the louver surrounded by neck 77 is of size and shape to slip over neck 73. The louver, however, is a separate molded piece.

A boss or wall 79 can be molded into the corners of the sleeves 70. The walls 79 have openings 80 therethrough through which a tie bolt 81 can pass.

It can be seen that a louver 78 can be slid over so that its neck portion 77 fits around the neck 73, and the shoulder formed by the recess 78 rests on the shoulder 72, to form the louver extending outwardly from the sleeve 70A. The lower sleeve at 70A has a sleeve 70B stacked on top of the louver 75, utilizing the internal shoulder 84 fomred by recess 83 in the bottom of each of the sleeves. The shoulder 84 then rests against the upper edge of neck 73, to make a tight fitting stacked louver and sleeve assembly. The louver 75 is held in place by the next higher sleeve 70B.

As a further variation, a sleeve 70C can have a lower edge that forms a peripheral flange 86 that is of the same length as the neck 73 of sleeve 70B, from the shoulder 72 to the outer edge, and two or more sleeves 70B and 70C can be stacked on top of the other as shown in FIG. 7 so that a lamp enclosure can be made with no louvers or the space between the adjacent louver 75 can be altered as desired. Each of the sleeves 70A, 70B and 70C can have the serrations or striations that will bend the light rays as desired to form the desired pattern.

Because the louvers 75 are made independently of the sleeve portions 70, they can be made of a different material, or can be made a different color, and they can be easily molded and assembled. Generally speaking, the sleeves 70 will be a clear prism sections, while the louvers 75 will be molded in a desired color or painted. The space indicated at 90 between the flange 76 of the louver and the outer surface of the sleeve supporting is where light can be reflected downwardly by having the bottom part of the flange of the louver formed as desired.

Figure 8:
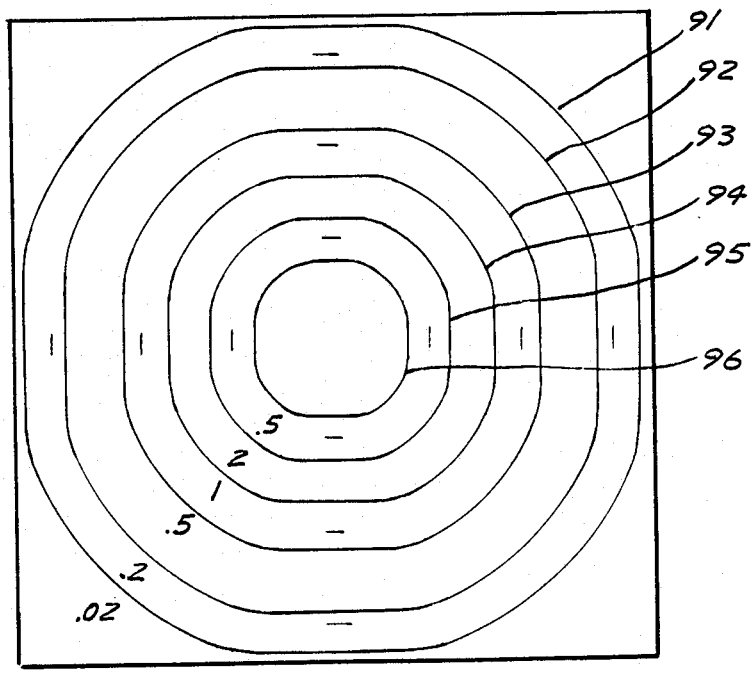
FIG. 8 is a representation of a typical light pattern achieved with a louver arrangement made according to the present invention and in particular the form shown in FIG. 7.

By forming the serrations on the sleeves and on the louvers in a desired manner, the configurations of light patterns shown in FIG. 8 can be arrived at. The FIG. 8 light pattern is for a square sleeve. Each of the lines indicated at 91, 92, 93, 94, 95 and 96 represent lines of substantially equal light as measured in foot candles. Thus, a desired brightness in the corners can be achieved in spite of the corner tie rods, so that shadows are eliminated.

With the telescoping or interfitting sleeve ends, comprising the shoulder surfaces and neck portions that overlap as shown in FIG. 7, a tight louvered lamp housing assembly can be made.

Figure 5:
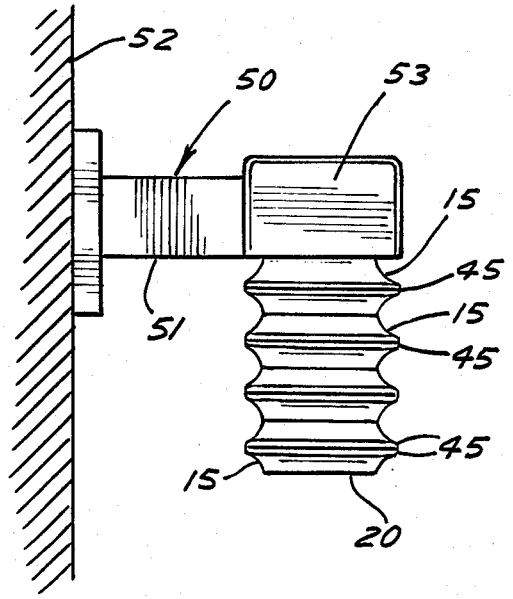
FIG. 5 is a side elevational view of a fixture mounted on a vertical surface showing a variation of the orientation of the louvers of the present invention.

The louver assemblies are relatively low cost, and can be tinted as desired with grey or bronze tints, and the outer surfaces of the louvers can be coated as desired. In this way, various attractive configurations can be made, and the interfitting or telescoping ends of the stacked louvers or the edges 45 insure that they are sealed from weather and insects. Of course, when the ends of the louvers are placed face-to-face as shown in FIG. 5, the joint is made with abutting surfaces, but there is a double surface seal, one out at the edge 45, and one at the edge of flange 37 to provide for adequate sealing to keep out insects, foreign objects and the like.

Although the present invention has been described with reference to preferred embodiments, workers skilled in the art will recognize that changes may be made in form and detail without departing from the spirit and scope of the invention.

I claim:

1. A louver assembly for a lighting fixture comprising a unitary sleeve, said sleeve having an axial direction with opposite ends spaced along the axial direction and defining a space around said axis, and a louver flange surrounding the sleeve and extending from one end of the sleeve outwardly away from the sleeve and in direction toward the other end of the sleeve to provide an overhanging louver flange, said sleeves being arranged to permit end-to-end stacking of a plurality of sleeve and louver flange assemblies with two surfaces of each sleeve and louver flange assembly abutting when assembled, at least every other sleeve having an end formed to provide a telescoping action with the next adjacent sleeve in the stack to align the sleeve and louver flange assemblies, and a plurality of apertures being formed through the sleeve at spaced locations to permit elongated fasteners to pass through a plurality of apertures to hold a plurality of said sleeve and louver flange assemblies in a stack.

2. The apparatus as specified in claim 1 and light refraction means formed on a surface of said sleeve, said light refraction means comprising a plurality of ribs and recesses extending generally axially along the sleeve to direct light from the center in desired directions.

3. The apparatus as specified in claim 1 wherein a sleeve and a louver flange are integraly molded from a plastic material to make a louver assembly, and said apertures are formed through ears on the interior of said sleeves, said fasteners comprising rod-type fasteners for clamping a plurality of sleeves in alignment in a stack.

4. The apparatus as specified in claim 1 wherein the telescoping action is formed by an internal shoulder at an end of one sleeve and an external shoulder at an end of a second sleeve to permit a first end of one sleeve to telescope relative to a second end of a second sleeve with the end surfaces of one of the telescoping sleeves abutting on a shoulder formed at the adjacent end of the other sleeve .

5. The apparatus as specified in claim 1 wherein said louver flanges extend from said first end of said sleeve to substantially a plane lying along the second end of said sleeve, said louver flanges terminating on said plane, wherein when two louver assembies are placed with the second ends of the respective sleeve facing, the peripheral edge surfaces of the louver flanges are substantially contiguous.

6. The apparatus as specified in claim 1 wherein the louver flanges has an upper surface and a lower surface, and a plurality of light refraction means formed into the lower surface to refract light emanating from the interior of said sleeve.

7. The apparatus as specified in claim 1 wherein the sleeve and louver flange assemblies are arranged in pairs, and the telescopings ends of sleeve are on sleeves of different pairs, the louver flange assemblies from each pair having louver flanges facing in opposite direction along the central axis of the stack, so the ends of the sleeves of the two sleeve and louver assemblies of each pair abut, and the louver flanges being formed so the outer edges thereof also abut when the sleeve and louver flange assemblies are formed into pairs.

8. The apparatus as specified in claim 6 wherein said louver sleeves are generally square in cross-section.

9. The apparatus as specified in claim 8 wherein said light refraction means comprise a plurality of ribs and recesses formed to extend on the underside of the louver flange, generally from one end of the flange to the other and on planes generally parallel to the central axis of the associated sleeve.

10. A light assembly comprising a plurality of stacked louver assemblies mounted in end-to-end relationship along a central axis, each of said louver assemblies comprising a central sleeve having first and second ends, and a louver flange mounted on each sleeve, said louver flange being mounted to its sleeve adjacent one end of the respective sleeve, and tapering outwardly from the respective sleeve in direction toward the opposite end of the sleeve, each of said louver assemblies having two mating surfaces at their ends facing another louver assemby in a stack, wherein at least two surfaces of each of the adjacent louver assemblies are substantially contiguous when the louver assembies are stacked in end-to-end relationship, said two substantially contiguous surfaces comprising end surfaces on said sleeves, said sleeves each having an internal shoulder formed therein at the first end and an external shoulder formed at therein opposite end, the shoulders being formed so that a sleeve telescopes into an adjacent sleeve and the end surfaces of each sleeve abut on a shoulder surface of the adjacent sleeve.

11. The apparatus as specified in claim 10 and tie rod means passing through the sleeves for forming said adjacent sleeves and louver flanges into a light fixture.

12. A lighting fixture housing comprising a molded sleeve capable of being stacked with other sleeves, each of said sleeves having a central axis, and extending in axial direction, and defining a space around the central axis, each sleeve having a neck at one end and a receptacle at the opposite end so that adjacent ends of first and second sleeves will stack with a first end of a first sleeve telescoping into a second end of a second sleeve for alignment and stacking purposes, a separate louver flange fitting over a first end of at least one sleeve, with a second sleeve overlying the louver flange when the second sleeve telescopes onto the one sleeve, the louver flange extending from a first end of the one sleeve toward a second end of the same sleeve, and means for retaining fasteners for clamping the sleeves axially.

13. The apparatus as specified in claim 12 and a seperate louver flange fitting over a first end of at least one sleeve and with a second sleeve overlying the louver when it fits over onto the one sleeve, the louve extending from a first end of the one sleeve toward a second end of the same sleeve.

14. The apparatus of claim 12 wherein the sleeve and the louver are made from molded plastic, having selected light transmitting qualities.

15. The apparatus of claim 14 and a pluralit of light refracting ridges molded into the wal of the sleeve for directing light in a desired pattern.

* * * * *

UNITED STATES PATENT AND TRADEMARK OFFICE

CERTIFICATE OF CORRECTION

PATENT NO. : 4,794,502

DATED : December 27, 1988

INVENTOR(S) : Arthur R. Guggemos

It is certified that error appears in the above-identified patent and that said Letters Patent is hereby corrected as shown below:

In the References Cited Section, add --Other Publications-- list the following:

--Brochure Entitled BOLLARDS - Four Quick Ship Choices From Sterner Published by Sterner Lighting Systems Incorporated Winsted, Minnesota - 1986.--.

Column 6, Line 22, delete "flanges" and insert "flange"

Column 8, Line 6, delete "louve" and insert "louver"

Column 8, Line 12, delete "pluralit" and insert "plurality"

Column 8, Line 13, delete "wal" and insert "wall"

Signed and Sealed this

Thirtieth Day of May, 1989

*Attest:*

*Attesting Officer*

DONALD J. QUIGG

*Commissioner of Patents and Trademarks*